United States Patent [19]

Adasek

[11] Patent Number: 5,066,044

[45] Date of Patent: Nov. 19, 1991

[54] SKI GUARDS

[76] Inventor: Kenneth P. Adasek, 11367 Nancy Dr., Warren, Mich. 48093

[21] Appl. No.: 496,945

[22] Filed: Mar. 21, 1990

[51] Int. Cl.[5] ..... A63C 11/02

[52] U.S. Cl. ..... 280/815; 280/814; 297/147

[58] Field of Search ..... 280/814, 815, 818, 47.131; 211/70.5; 294/147; 224/917; 150/166

[56] References Cited

U.S. PATENT DOCUMENTS

| | | | |
|---|---|---|---|
| 3,620,543 | 11/1971 | Peis | 280/814 X |
| 3,731,348 | 5/1973 | Luehne | 280/814 |
| 4,238,063 | 12/1980 | O'Dair | 211/70.5 X |
| 4,419,872 | 12/1983 | Plifka | 294/147 X |
| 4,772,047 | 9/1988 | Leaf | 280/815 |
| 4,830,403 | 5/1989 | Ohmori | 280/815 |

FOREIGN PATENT DOCUMENTS

| | | | |
|---|---|---|---|
| 3439278 | 8/1985 | Fed. Rep. of Germany | 280/814 |
| 1552202 | 1/1969 | France | 220/814 |
| 2595580 | 9/1987 | France | 280/814 |
| 8061761 | 9/1980 | PCT Int'l Appl. | 280/814 |
| 8607275 | 12/1986 | PCT Int'l Appl. | 280/814 |
| 418201 | 2/1967 | Switzerland | 280/814 |
| 451775 | 5/1968 | Switzerland | 280/814 |
| 581487 | 11/1976 | Switzerland | 280/814 |

*Primary Examiner*—Andres Kashnikow
*Assistant Examiner*—Brian L. Johnson
*Attorney, Agent, or Firm*—John C. Evans

[57] ABSTRACT

A ski guard assembly includes two pairs of tip guard members and two pairs of tail guard members which combine to protect the metal edges of different length skis. Each of the guard members includes a base portion with two spaced side walls forming an open channel for capturing only the tips and tails of a ski so as to protect the top and corners of the tips and tails while shielding sharpened metal side edges thereof against damage to the side edges or against damage to other objects coming into contact with the skis. The side walls and bottom portion define a closed end and an open end. Grooves are formed in each of the spaced side walls adjacent the open ends of each of the guard members to accommodate a connection strap for holding a pair of skis together while retaining each one of a pair of skis within the guard members.

12 Claims, 2 Drawing Sheets

SKI GUARDS

FIELD OF THE INVENTION

This invention relates to ski guards for shielding the metal edges as well as the tops and corners of skis and more particularly to ski guards for protecting such sharpened metal edges during transportation of the skis.

BACKGROUND OF THE INVENTION

Present day high performance downhill skis are characterized by metal ski edges on composite laminated structures formed from epoxy plastic, high strength woven fiber material such as carbon filament or Kelvar filaments; glass fiber/epoxy material and the like. Such skis may include a top cover of a suitable decorative form in materials such as melamine or phenolic plastics. In all such cases the metal ski edges are sharpened to provide adequate edging on ice or hard pack snow surfaces encountered during downhill skiing.

One problem with such skis arises during their transportation either by car or air. To transport such skis the pair of skis are strapped together as a unit and either placed on a ski rack on a car or are placed in a ski bag for transportation by air. Such handling causes the sharpened ski edges to come into contact with other objects. Furthermore, such handling can crack the top corners of the skis or damage the tops and bottoms of the skis. If the objects are abrasive or hard they can dull or nick the sharpened edge surfaces in an undesirable manner. Alternatively, the sharpened metal edges can damage articles or objects which come into contact with the exposed edges.

In order to avoid such damage various ski coverings have been proposed to protect a metal ski edge.

DESCRIPTION OF PRIOR ART

U.S. Pat. No. 3,424,469 discloses a downhill ski with a protective edge strip that is fixed to the upper edge surface at the tip of the ski to form a fender or bumper that protects the upper surface of the ski against damage caused when the sharpened metal edge of another ski runs across the protected ski tip. The protective strip becomes part of the ski and is formed in segments to yield as the ski body is flexed during use. The strips do not protect the ski edges from external objects during shipping. Furthermore, they are permanently joined to the ski in a manner that can affect desired performance characteristics of the ski.

U.S. Pat. No. 4,006,912 discloses a ski edge protector which includes a single integrally formed boot like member that is elastic and has closed pockets on its opposite ends to capture the tip and tail of a guarded ski. The boot like member is fit on a ski by extending and retracting a heel portion with respect to the tail of a ski. The amount of retraction is limited by the elasticity of the boot material. If the material is relatively inelastic it will only fit on a limited range of ski lengths. If the material is highly elastic to accommodate a wider range of ski lengths, it will yield to exterior contact with objects and resultant impact can cause the sharpened edges of the protected ski to be damaged.

U.S. Pat. No. 4,012,050 discloses another elastic boot type protector in which velcro fasteners are formed on the bottom of each of the boots to connect a pair of skis together for transport. As in the case of the '050, the boot is made of an elastic material which itself can be cut by sharpened ski edges or be penetrated by external objects to dull the ski edges. Less elastic boots will not accommodate the wide range of ski lengths used in downhill skiing.

The present invention includes non-elastic hard plastic guard members which are configured to accommodate different length skis and which will protect sharpened ski edges without becoming a permanent part of the ski body.

The present invention includes a pair of tip guard members and a pair of tail guard members separated from one another and formed of a hard plastic material which will protect sharpened ski edges against impact by objects encountered during transportation and handling of the skis.

The present invention further includes a pair of tip guard members and a separate pair of tail guard members each of which include side walls for protecting the sharpened metal edges of a ski. The side walls have connection grooves for straps to join the tip guards and skis as a unit while retaining individual skis in the tip and tail guard members.

SUMMARY OF THE INVENTION

The present invention in a preferred embodiment includes a first pair of hard plastic tip guard members and a second pair of hard plastic tail guard members each of which tip guard member and tail guard member includes a base portion and a pair of spaced side walls forming an open channel having a closed end and an open end in which either the tip or tail of a ski can be slipped to align the sharpened metal edges of the ski with the inner surface of the side walls to protect the metal edges against impact by other objects during transport or storage.

The side walls have grooves therein adjacent the open end of each of the open channels to receive straps wrapped around the assembled guard members for holding the skis together as a unit and for retaining each of the skis in the open channels.

If desired, separable retainers can be provided on the outboard surface of each of the guard members adjacent their closed ends to removably connect the guard members and the skis captured therein together at a point near the tip and tail of the skis.

A further feature of the invention is the provision of ventilation holes in the base portion of each of the guard members for providing air circulation around the edges to prevent rust build-up during storage and transport.

OBJECTS OF THE INVENTION

Accordingly an object of the present invention is to provide ski top guard members for protecting the top surface, corners and metal edges of the skis during transport and storage which include hard plastic guard members that will fit on a wide range of lengths of skis.

Another object of the present invention is to provide such ski guard members wherein separate tip and tail guard members are provided; each of the guard members having a base portion and spaced side walls forming an open ended channel in which the ends of the skis can be slipped for covering only the metal edges of the skis and wherein the side walls are configured to receive straps for holding the guard members together and to hold the skis in each of the guard members for transport as a unit.

Another object of the present invention is to provide ski guard members of either of the preceding objects wherein the guard members are made of an impact resistant material which will protect the metal edges against damage by other objects during transport or storage.

Still another object of the present invention is to provide a ski guard design which will fit in close conformity with a wide range of ski lengths so as to protect the metal edges of a pair of skis in a unified package for independent air transport or to easily fit within ski transport bags for air transport and which unified package is suitable for mounting on ski racks for car transportation.

Yet another object of the present invention is to provide a ski guard design which is easily fabricated from known materials and which will be light weight and which will be adaptable for protection of the metal edges on a wide range of ski lengths and types.

Another object of the present invention is to provide such ski guard designs having ventilating holes for circulating air to allow drying of the edges of guarded skis during their transport or storage.

These and other objects and advantages will be more apparent when reference is made to the following drawings and the accompanying description.

DETAILED DESCRIPTION OF THE DRAWINGS

DESCRIPTION OF PREFERRED EMBODIMENT

Figure 1:
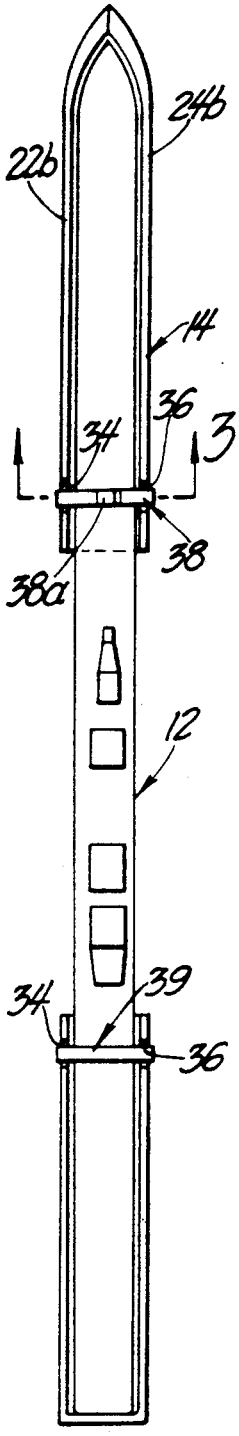
FIG. 1 is a front elevational view of the ski guards of the present invention installed on a pair of downhill skis.
Figure 2:
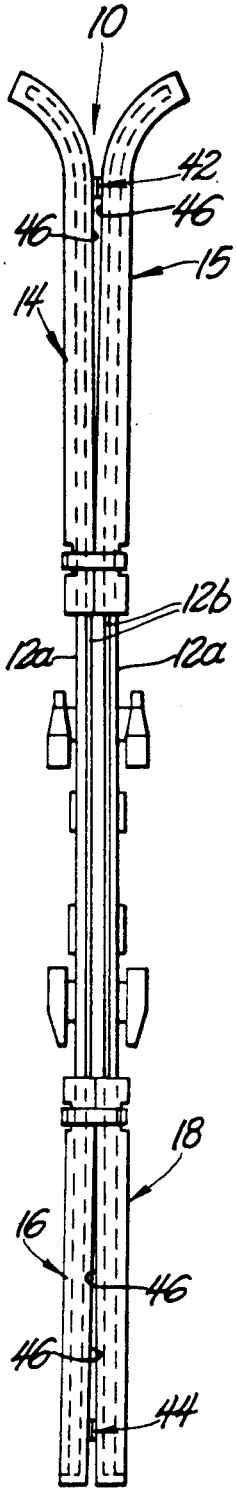
FIG. 2 is a side elevational view of ski guards shown in FIG. 1.

Referring now to FIG. 1 and 2 a ski guard assembly 10 is illustrated assembled on a pair of skis 12. The ski guard assembly 10 includes a pair of tip guard members 14, 15 and a pair of tail guard members 16, 18.

Figure 4:
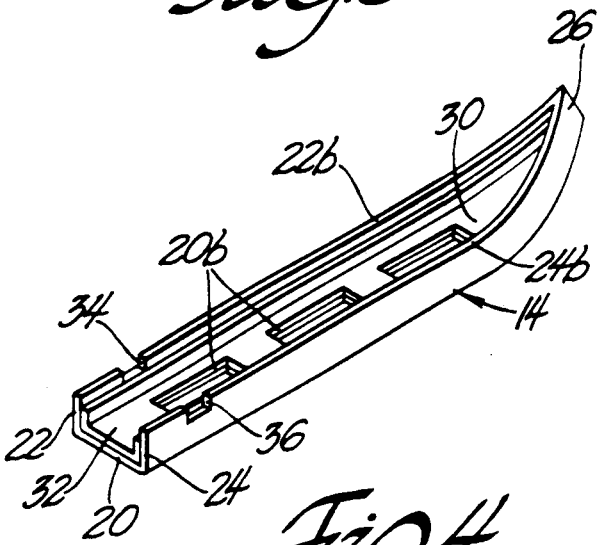
FIG. 4 is a perspective view of a tip guard member of the present invention.
Figure 5:
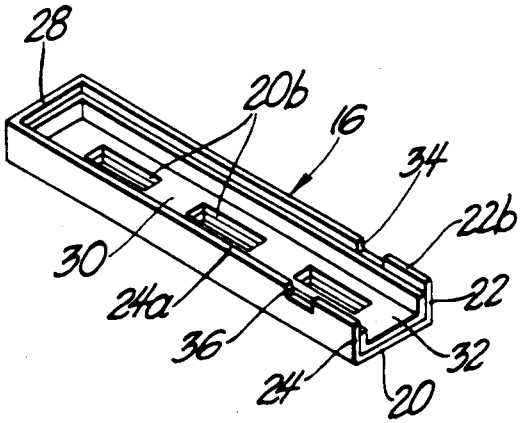
FIG. 5 is a perspective view of a tail guard member of the present invention.

As shown in FIGS. 4 and 5 each of the tip guard members 14, 15 and tail guard members 16,18 are formed as separable units which are adapted to fit over the ends of a wide range of different length skis.

Each of guard members 14–18 are made of an impact resistant hard plastic material such as ABS plastic. Such plastic is easy to mold with known equipment. Each of the guard members 14–18 includes a base portion 20 having integrally formed spaced side walls 22, 24 formed along the length thereof and integrally joined with either a tip portion 26 or a tail wall 28 to form a closed end on each of the guard members 14–18. Together the base portion 20 and side walls 22, 24 form an open channel 30 into which either the ski tip or ski tail is easily slipped. The open ended channel 30 is closed at one end by the tail wall 28 or tip portion 26 and each of the open ended channels extend through an open end 32 of each of the guard members 14–18. The height of each of the side walls. 22, 24 extends a constant distance X (FIG. 3) above the top surface 12*a* of each ski comprising the pair of skis 12. The height extension of the side walls thus protects the ski top and top ski corners from cracking during handling.

In one embodiment the inner surfaces 20*a*, 22*a*, and 24*a* of the base portion 20 and the side walls 22, 24 are covered by a foam layer 33 of soft protective urethane material to prevent scuffing or other damage to the bottom material of the skis 12. In another aspect of the invention the base portion 20 and foam layer 33 can have slots 20*b* formed therein to reduce the weight of the guard members 14–18 and to form a ventilation opening for passage of air across the guard metal edges to prevent side edge corrosion during shipment or storage.

Figure 3:
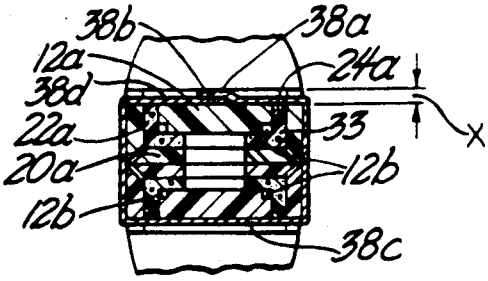
FIG. 3 is an enlarged cross-sectional view taken along line 3—3 of FIG. 1 looking in the direction of the arrows.

Another aspect of the present invention is the provision of lock grooves 34, 36 in each of the side walls 22, 24 at the open end 32 of each of the guard members 14–18. The lock grooves 34, 36 of the tip guard members 14, 15 are axially aligned when the guard members 14, 15 are slipped on the pair of skis 12 as shown in FIG. 2. The lock grooves 34, 36 define a interlock for a strap 38 which wraps around each of the tip guard members 14, 15 adjacent the open end 32 thereof. The strap 38 has opposite ends 38*a*, 38*b* with VELCRO hook and loop type fasteners formed thereon to secure the strap 38 in place so as to hold the tip guard members 14, 15 and tips of the skis 12 together as a unit. As shown in FIG. 3, the reaches 38*c* and 38*d* of the strap 38 also capture the pair of skis 12 in the open channel 30 to prevent escape of the guarded skis 12 from the tip guard members 14, 15.

Likewise, the lock grooves 34, 36 of the tail guard members 16, 18 receive a strap 39 having the same component parts as the strap 38. The strap 39 is seated in the lock grooves 34, 36 of each of the tail guard members 16, 18 , wrapped and secured in the same manner as strap 38 for the same purpose, namely to capture the tails of the skis 12 together as a unit and to capture each of the tails in the open channel 30 of the respective tail guard member 16, 18 slipped thereover. While a VELCRO hook and loop type fastener strap is illustrated the straps can take other forms such as rubber straps with metal end fasteners or elastic bands of continuous circular form.

As seen in FIGS. 1 and 2 the guard members 16, 18 protect metal edges 12*b* in all but the center portions of the ski upon boot bindings 40 are located. The guard members 16, 18, directly protect the normal points of impact when the tip and tail of the pair of guarded skis 12 are placed in racks, conveyors or the like. Further, when the guarded skis 12 are placed horizontally on a support surface or conveyor, the outer edge surfaces 22*b*, 24*b* of the side walls 22, 24 will space the metal edges at the center of the skis 12 from the adjacent objects to prevent undesirable contact with the protected edges.

The ski guard of the present invention is thus configured and adapted for use with a wide range of ski lengths and types. It will provide good impact protection at the top, bottom, top corners and metal edges of the ski 12 at the most vital segments of the metal edges used to carve turns, namely the forward and aft edge portions of the skis 12.

Further the ski guards of the present invention provide a unitized package of guards and skis when connected by straps 38, 39. If additional connection is required pairs of separable fasteners 42, 44 can be connected between the outboard surface 46 of each of the guard members 14–18 as shown in FIG. 2. The separable fasteners 42, 44 can be magnet and armature plates fixedly connected respectively to juxtaposed surfaces 46 adjacent the tip and tail of the skis 12 as illustrated. Alternatively the separable fasteners can be VELCRO hook and loop type fasteners with the loop portion fixed to one of the surfaces 46 and the hook portion fixed to the other of the surfaces 46.

Figure 6:
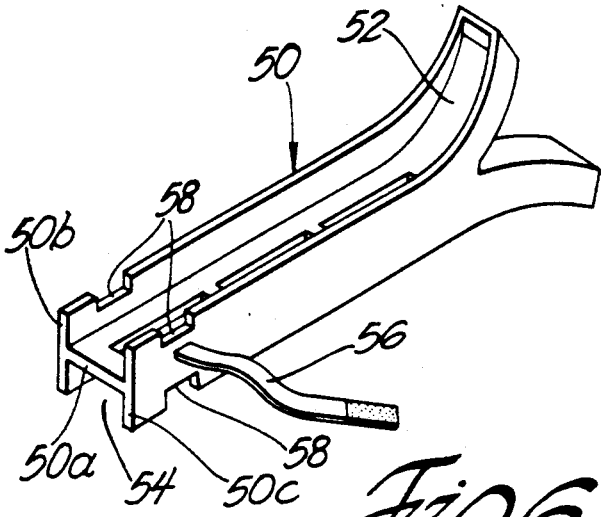
FIG. 6 is a perspective view of a tip guard member of another embodiment of the invention.
Figure 7:
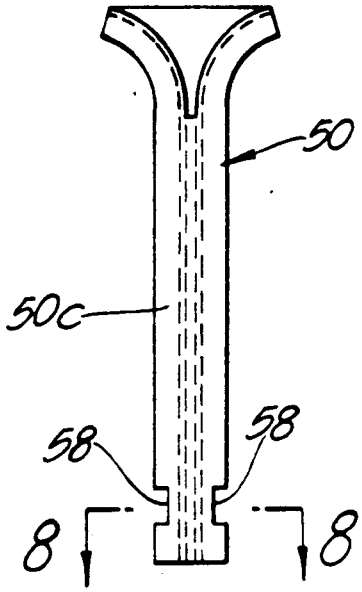
FIG. 7 is a side view of the tip guard of FIG. 6.
Figure 8:
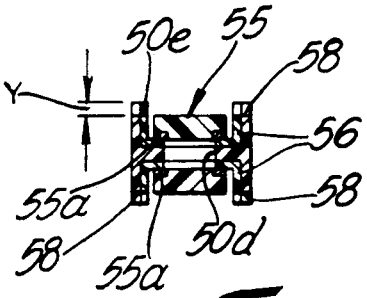
FIG. 8 is a cross section along line 8—8 of FIG. 7, looking in the direction of the arrows.
Figure 9:
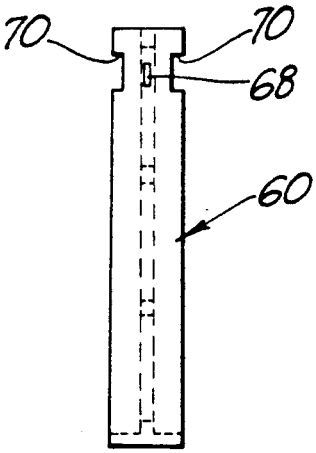
FIG. 9 is a side view of a tail guard member of another embodiment of the invention.

Another embodiment of the invention is shown in FIGS. 6–11. FIGS. 6–8 show a one piece tip guard 50 having a H-shaped cross section defining a pair of openings 52, 54 adapted to receive skis 55. As shown in FIG. 9, the skis 55 are separated by a cross member 50*a*. A layer of foam 56 is interposed between each ski 55 and the tip guard 50. Side walls 50*b*, 50*c* of the tip guard 50 extend above the top of each of the skis 55 to guard their top and top corners. Metal edges 55*a* on each ski are protected by guard 50 as shown in FIG. 8. A VELCRO strap 56 is connected to side wall 50*c* and is configured to loop across spaced grooves 58 in each side wall 50*b*, 50*c* to hold the ski tips in place. Holes 50*d* are provided in cross member 50*a* to ventilate the openings 52, 54 to prevent side edge corrosion. Top wall edges 50*r* are formed a constant distance Y above the skis 55 to protect their top and top corners.

Figure 10:
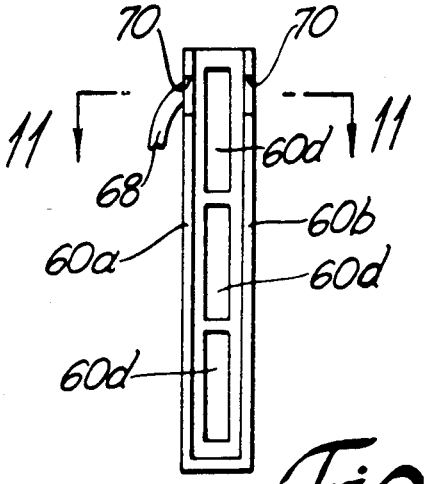
FIG. 10 is an end view of the tail guard member of FIG. 9.
Figure 11:
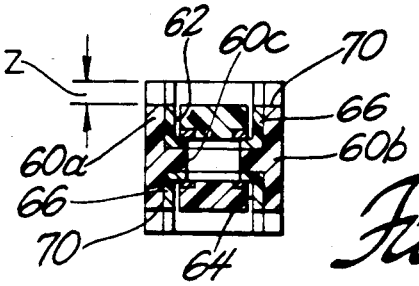
FIG. 11 is a cross section along line 11—11 of FIG. 9, looking in the direction of the arrows.

FIGS. 9–11 show a unitary tail guard 60. It has two spaced tip openings 62, 64 to receive the tails of skis 55. The tail guard 60 has foam members 66 on either side of walls 60*a*, 60*b*.The walls 60*a*, 60*b* are joined by a cross member 60*c*. The walls 60*a*, 60*b* extend above the top of each of the guarded skis 55 along their full length a constant distance to protect the top and top corners of the ski tails. The foam members 66 protect the metal edges 55*a* of the skis 55. Holes 60*d* are provided in the cross member 60*c* and foam members 66 to provide air circulation to dry the guarded skis 55. A VELCRO strap 68 connected to wall 60*a* will loop through spaced grooves 70 in the side walls 60*a*, 60*b* to hold the ski tails in placed.

These and other embodiments of the present invention are possible in light of the above teachings. It is, therefore, to be understood that within the scope of the appended claims the invention may be practiced otherwise than as specifically described.

What is claimed is:

1. A ski edge guard assembly for use with skis of different lengths, the skis having tips, tails, sides, tops with top corners and bottoms with bottom edges comprising:

a pair of rigid tail guard members having a closed end and an open end for removably receiving the tails of a pair of skis and said tip guard members including a base portion juxtaposed against the bottom of each ski of the pair of skis and including oppositely facing outboard surfaces when installed on the pair of skis;

a pair of rigid tip guard members having a closed end and an open end for removably receiving the tis of the pair of skis and each of said tip guard members including a base portion juxtaposed against the tip of each ski of the pair of skis and said base portions of said tip guard members having oppositely facing outboard surfaces when installed on the pair of skis;

first fasteners means secured on said oppositely facing outboard surfaces of said tail members and said tip guard members for joining said tail guard members and said tip guard members at an intermediate point thereon for providing spaced connection points between the pair of skis between the opposite ends thereon; said tail guard members and said tip guard members having sidewalls of a height which covers the sides of the skis and said sidewalls and said base portions of said joined tail guard members and said tip guard members forming an H-shaped cross-section therethrough; and second fastener means secured on said tail guard members for holding said tail guard members together and for holding the ski tails in said tail guard members when assembled thereon and third fastener means secured on said tip guard members for holding said tip guard members together and for holding said tips in said tip guard members;

said second and third fastener means including means on the open end of said tail guard members and on the open end of said tip guard members for defining a lock groove and retention means located in said lock groove for joining said tail guard members and said tip guard members at the open ends thereof.

2. The assembly of claim 1 wherein said tail guard members and tip guard members are formed of impact resistant inelastic material.

3. The assembly of claim 2 wherein said inelastic material is a polymer of acrylonitrile, butadiene and styrene.

4. In the assembly of claim 1;

each of said tip guard members and each of said tail guard members having spaced parallel side walls extending above the ski sides and grooves formed in said side walls at the open ends of said tail guard members and said tip guard members for defining said lock grooves.

5. In the assembly of claim 4;

said retention means includes strap members looped around the tail guard members and tip guard members adjacent the open ends thereof and received in said lock grooves for bearing against the top of the skis to prevent separation of the skis from said tail and tip guard members.

6. In the assembly of claim 5;

means forming openings in said base portion for reducing the weight of each of said tip guard members and each of said tail guard members while defining a path for circulation of air around the bottom edges of the skis.

7. A ski edge guard assembly for covering the tips, tails, sides, tops and bottoms of a pair of skis having bottom edges and top corners comprising:

and H shaped cross-section tail guard member having raised side walls and a cross-member connected to said side walls forming a pair of U-shaped pockets with a closed end and an open end for removably receiving the tails of a pair of skis and each of said tail guard members including a surface adjacent the bottom of each ski of the pair of skis;

said raised side walls having a height which fully covers the sides of each pair of said pair of skis at the tails thereof;

an H shaped cross-section tip guard member having raised side walls and a cross-member connected to said sidewalls forming a pair of U-shaped pockets with a closed end and an open end for removably receiving the tips of a pair of skis and each of said tip guard members including a surface adjacent the tip of each ski of the pair of skis;

said raised sidewalls having a height which fully covers the sides of each pair of said pair of skis at the tips thereof;

first fastener means secured on said tail guard member for holding the tails of the pair of skis in said tail guard member and second fastener means secured on said tip guard member for holding the tips of the pair of skis in said tip guard member; and said first and second fastener means including means on the open end of said U-shaped pockets in said tail guard member and on the open end of said U-shaped pockets in said tip guard member for defining lock grooves and retention means located in said lock grooves for joining said pair of skis to said tail guard members and said tip guard member.

8. The assembly of claim 7 wherein said tail and tip guard members are formed of impact resistant inelastic material.

9. The assembly of claim 8 wherein said inelastic material is a polymer of acrylonitrile, butadiene and styrene.

10. In the assembly of claim 7;

means forming openings in said tip guard member and said tail guard member for reducing the weight of said tip guard member and said tail guard member while defining a path for circulation of air around the bottom edges of the skis.

11. In the assembly of claim 7, said tip guard member and said tail guard member having raised sidewalls with a height which extends a fixed distance above the tops of the skis to protect the tops and top corners of the skis.

12. In the assembly of claim 11, said retention means including a strap member looped around each of the tail guard member and the tip guard member adjacent the open end thereof; lock grooves formed in the top edges of said sidewalls of said tail guard member and the tip guard member for receiving said strap members and for locating said strap members against the tops of the skis to prevent separation of the skis from the tail and tip guard members.

* * * * *